United States Patent [19]

Gettig

[11] Patent Number: 5,071,011

[45] Date of Patent: Dec. 10, 1991

[54] NECKTIE RACK

[76] Inventor: William A. Gettig, Box 417, Millheim, Pa. 16854

[21] Appl. No.: 620,044

[22] Filed: Nov. 30, 1990

[51] Int. Cl.[5] ..... A47F 5/00

[52] U.S. Cl. ..... 211/13; 211/87

[58] Field of Search ..... 211/89, 87, 13, 45

[56] References Cited

U.S. PATENT DOCUMENTS

| | | | |
|---|---|---|---|
| 2,007,636 | 7/1935 | Brothers | 211/87 |
| 2,422,922 | 6/1947 | Nudelman et al. | 211/89 X |
| 3,297,168 | 1/1967 | Fleming | 211/89 |
| 3,762,570 | 10/1973 | Tobin | 211/89 X |
| 4,946,049 | 8/1990 | Silverberg | 211/87 |

FOREIGN PATENT DOCUMENTS

| | | | |
|---|---|---|---|
| 115487 | 6/1929 | Fed. Rep. of Germany | 211/89 |

*Primary Examiner*—Robert W. Gibson, Jr.
*Attorney, Agent, or Firm*—Richard C. Litman

[57] ABSTRACT

A rack for neckties includes a base member from which project a plurality of stationary elongated pins laterlly spaced from one another a small specified distance calculated to allow the insertion and removal of the tail end of neckties. The closeness of the pin spacing permits the accommodation of approximately seventy-five neckties per foot of rack length, with all of the tires being retained in a fully suspended manner, free of folds and wrinkles. The retention of the neckties is accomplished due to one or more features evident in the construction of the tail end portion of all neckties and which provides an increased bulk in the material of the tie. The dimension of this increased bulk exceeds that of the spacing between two adjacent pins and accordingly serves to retain the neckties.

11 Claims, 2 Drawing Sheets

FIG. 1
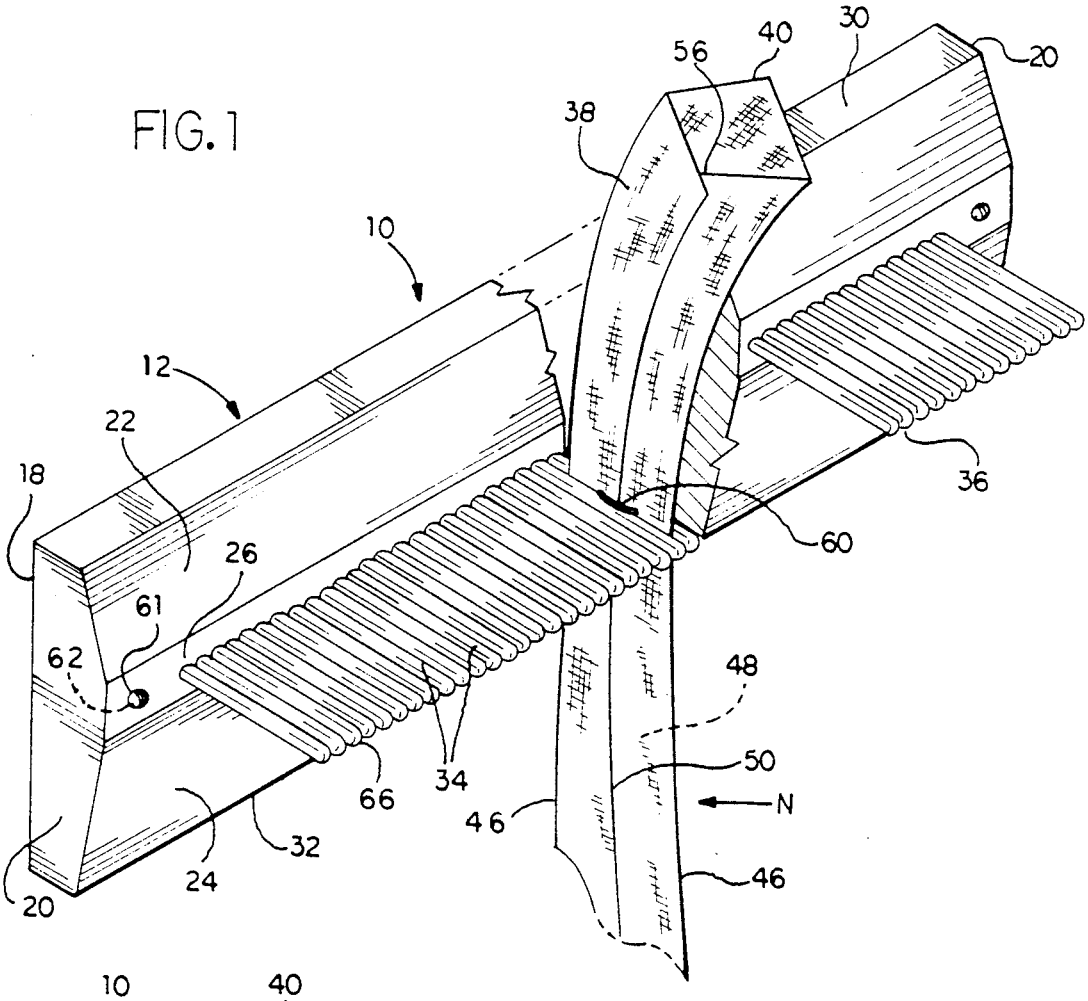
FIG. 2
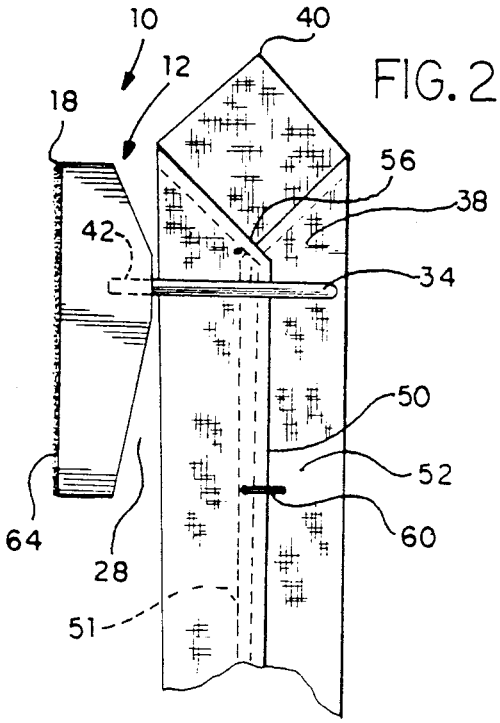
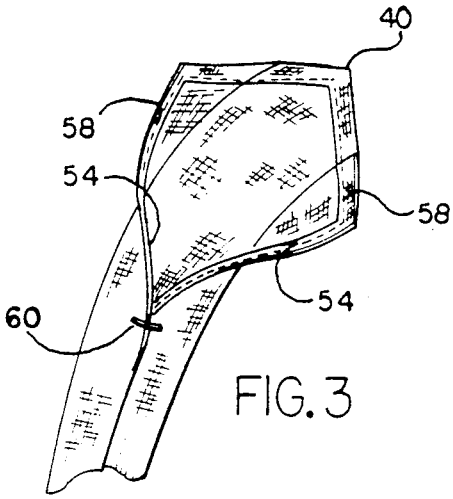
FIG. 3

NECKTIE RACK

FIELD OF THE INVENTION

This invention relates generally, to support devices and more particularly, to an improved necktie hanger.

BACKGROUND OF THE INVENTION

The need has long existed for storage or support means for a collection of neckties and which would enable a user to have immediate and ready access to any one of a large number of supported neckties. A shortcoming of many known devices is the limited capacity thereof and/or the need to manipulate pivoted or rotary members in order to examine and gain access to one particular necktie. The most beneficial support device is one wherein every one of a large number of neckties will at all times be instantly viewable and removable without manipulation of any structural member(s). Additionally, it is desirable that the neckties be fully suspended from one end thereof rather than draped or folded over a support member. Quite obviously, the latter type of device more than halves the capacity of any one hanger member, not to mention the tendency for such draped neckties to become wrinkled.

DESCRIPTION OF THE RELATED ART

It is known to provide a necktie rack comprising a base member having a plurality of adjacently disposed elongated members projecting therefrom and over which neckties are draped. Examples will be found in U.S. Pat. No. Des. 127,295 issued to Franklin and U.S. Pat. Des. No. 168,529 issued to Baker et al. In order to accommodate a large number of neckties on a single rack it has been proposed to provide a plurality of staggered rows of elongated members on a base element, as shown in U.S. Pat. No. Des. 291,031 issued to Luongo. The true suspension of strap-like devices such as belts, by means of closely spaced elongated members is also known as depicted in U.S. Pat. No. 4,834,248 issued to Lee. Suspension of the belts is achieved due to the disparate component at the end of each belt, namely the much bulkier buckle. U.S. Pat. No. 3,993,205 issued to Pilchard illustrates an example of a hanger for neckties, with an enlarged portion thereof being captively engaged within the valleys of a continuous piece of formed wire. None of these prior art devices is seen to suggest the instant arrangement wherein an extremely large number of neckties are fully suspended, from their tail end and by means of wedging action as provided due to the increased thickness evident by either the transverse stitching provided adjacent the very tip of the necktie tail or, the combined folds of the necktie material in this same area.

SUMMARY OF THE INVENTION

By the present invention, an improved necktie rack is provided and which comprises a unitary base member, preferably having a restricted height outer face and from which project a plurality of rigid, polished pins. With a control over the diameter of the pins and the space between adjacent pairs of pins, the tail end of neckties may be easily slipped between any two adjacent pins and will be retained, in a fully suspended manner, devoid of wrinkles and readily viewable and removable. With the base member relieved, away from the pin attachment surface of the base, the rearmost edge of the suspended neckties remain clear of any part of the base member and thus are truly freely suspended throughout their length, even in the case of extra wide neckties.

Accordingly, one of the objects of the present invention is to provide an improved necktie rack having a plurality of parallel pins critically spaced from one another to permit the suspension of the tail end of neckties therebetween.

Another object of the present invention is to provide an improved necktie rack including a plurality of elongated elements defining spaces therebetween insuring the captive retention of the tail end of unfolded neckties.

A further object of the present invention is to provide an improved necktie rack including a base member having a single row of closely spaced pins projecting from an outer surface on the base member which is disposed in a vertical plane removed from the balance of the base member such that neckties suspended between adjacent pins will remain free of contact with the remainder of the base member and any cooperating door or wall upon which the rack is mounted.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

FIG. 1 is a front perspective view, with portions broken away, of the necktie rack of the present invention;

FIG. 2 is an end elevation of the rack and illustrates a necktie being suspended in a manner alternate to that as in FIG. 1;

FIG. 3 is a partial perspective view of the tail end of a necktie, illustrating the typical construction thereof;

Similar reference characters designate corresponding parts throughout the several figures of the drawings.

DESCRIPTION OF THE PREFERRED EMBODIMENT

Figure 5:
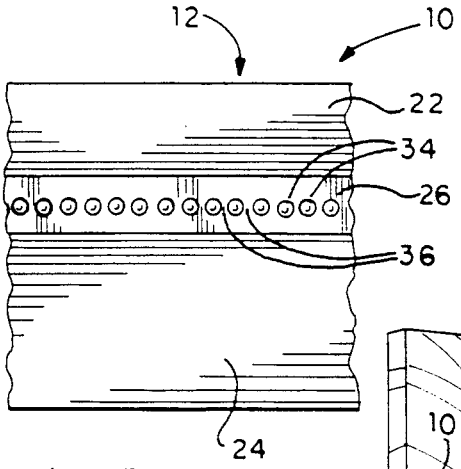
FIG. 5 is a fragmentary front elevation more clearly depicting the relationship between the pin diameter and the intermediate spaces.

Referring now to the drawings, the present invention will be seen to comprise a necktie rack, generally designated 10 and which includes a horizontally disposed, elongated main body or base member 12. The material of this member may comprise any suitable composition allowing of the attachment of the pins to be described later on. This will include any of various woods as well as numerous types of synthetic resinous products. The rack is intended to be mounted substantially at eye level, upon any suitable vertical surface, such as the inside face 14 of a closet door 16. Quite obviously, any other stationary or movable vertical surface may be utilized to mount the rack, such as a fixed wall within a closet. As will be appreciated hereinafter, a feature of the instant device is that neckties suspended from the rack 10 will not become dislodged therefrom even when the rack is mounted upon a movable member that is subjected to swinging or slamming shut.

The base member 12 preferably comprises a unitary body having a planar rear surface 18 and opposite end walls 20—20. As will be seen most clearly in FIGS. 1 and 2, the cross-sectional configuration of the base member 12 is irregular and includes inclined upper and lower outer faces 22, 24 respectively joined to a vertically disposed, forwardmost intermediate face 26, the latter preferably disposed in a vertical plane. With this construction, the forwardmost face 26 will be seen to be disposed in a plane forward of the remainder of the base member 12 such that a decided clear area 28 exists beneath the face 26 as shown in FIG. 2, with this area progressively increasing in depth from the face 26 downward. The upper face 22 is joined to the rear surface 18 by a top wall 30 while a bottom wall 32 connects the lower face 24 to the rear surface 18. Although the upper and lower faces are shown as comprising planar, inclined or chamfered surfaces, quite obviously these two faces each alternatively may comprise a single concave, convex or otherwise contoured surface continuously extending from the outermost face 26, respectively to the rear surface 18.

Retention means, by which one or more neckties N are held in a fully suspended manner, are provided by a plurality of pins 34 projecting outwardly from the plane of the base member face 26, preferably perpendicular thereto. To maximize the capacity of any length of base member, these pins are positioned throughout its length, between the two end walls 20—20. The construction, dimension, attachment and spacing of the pins 34 is quite critical in order for the present invention to function in a proper manner. Stainless steel wire stock or material exhibiting similar characteristics is preferred for several reasons. In view of the small diameter of the pins, i.e., within the range of 0.095–0.105 inches and preferably about 0.100 inch, a strong stiff and non-malleable material must be used as any accidental bumping against the installed pins must not result in permanent deformation of their original disposition or the spacing therebetween. Additionally, stainless steel or the like material resists corrosion and possesses a natural polish and low coefficient of friction. These latter properties will preclude tearing or snagging of even silk or woolen neckties. At this point it should be appreciated that it is not friction between the material itself of any two adjacent pins 34 and a captive necktie that retains the necktie in the illustrated suspended position. Rather, it is the relationship between the space 36 and the specific construction which is normal to all neckties in the specific area adjacent their tail end 38.

The pins 34 preferably project from the base member face 26 a length of substantially 1.25 inches, a distance which is significantly greater than one-half the width of a necktie, in the area spaced 1.5 to 3.0 inches from the tip 40 of the tail end 38. To insure maintenance of the stability of the mounted pins 34, each pin includes an inner tip 42 having a length of about 0.25 inches suitably embedded within the material of the base member. The pins 34 are mounted with their axes disposed normal to the plane of the base member face 26 while insuring parallelism between all pins and a space 36 between their opposed peripheries of 0.065–0.075 inches or preferably 0.070 inches, for reasons which will become apparent hereinafter.

The free suspension of neckties from the present rack 10 is achieved in view of the specific construction normally found in all neckties. As will be seen in FIGS. 2–4 of the drawings, a typical necktie N comprises a flexible body having a front or point end 44 joined to the opposite tail end 38 with lateral edges 46—46 comprising substantially straight lines tapering inwardly from the widest area adjacent the point 44 to the tail 38. The particular fabric of the necktie extends in an uninterrupted manner throughout the full extent of the outer surface 48, is folded back upon itself along the lateral edges 46 with the distal left and right edges 50–51 stitched into an overlapping arrangement upon the back 52 of the necktie. Each of these distal edges 50–51 will be understood to result in a folded condition in view of the inturned flap 54 of fabric beneath each edge 50–51. When viewing a necktie tail end 38 from the reverse side 52, the left-hand edge 50 will always overlie the right-hand edge 51 such that no less than five layers of fabric plus that of any lining present, will exist. With this construction, and in view of the narrow width of the necktie adjacent the tail end 38, the maximum bulk or thickness and the greatest resistance to compression of the necktie material will be understood to exist as one approaches the tip 40 and reaches the tail end V-notch area 56. This thickness will be even greater at the immediate point or intersection of the V-notch, in view of the inturned flaps 58 forming this V-notch area 56. This increased bulk or overall thickness of the necktie in this area serves as one means of freely suspending the necktie N as shown in FIG. 2. Alternatively, many neckties may be suspended with the same rack 10 from a point slightly further removed from the tail end tip 40 and in an area slightly inward of the V-notch 56. The majority of neckties include a tack thread 60 as shown in FIG. 1 which extends transversely of the necktie width to bind together the two overlapping distal edges 50–51. The added bulk provided by this tack thread 60 will be sufficient to freely suspend the necktie N between any two adjacent pins 34.

Figure 4:
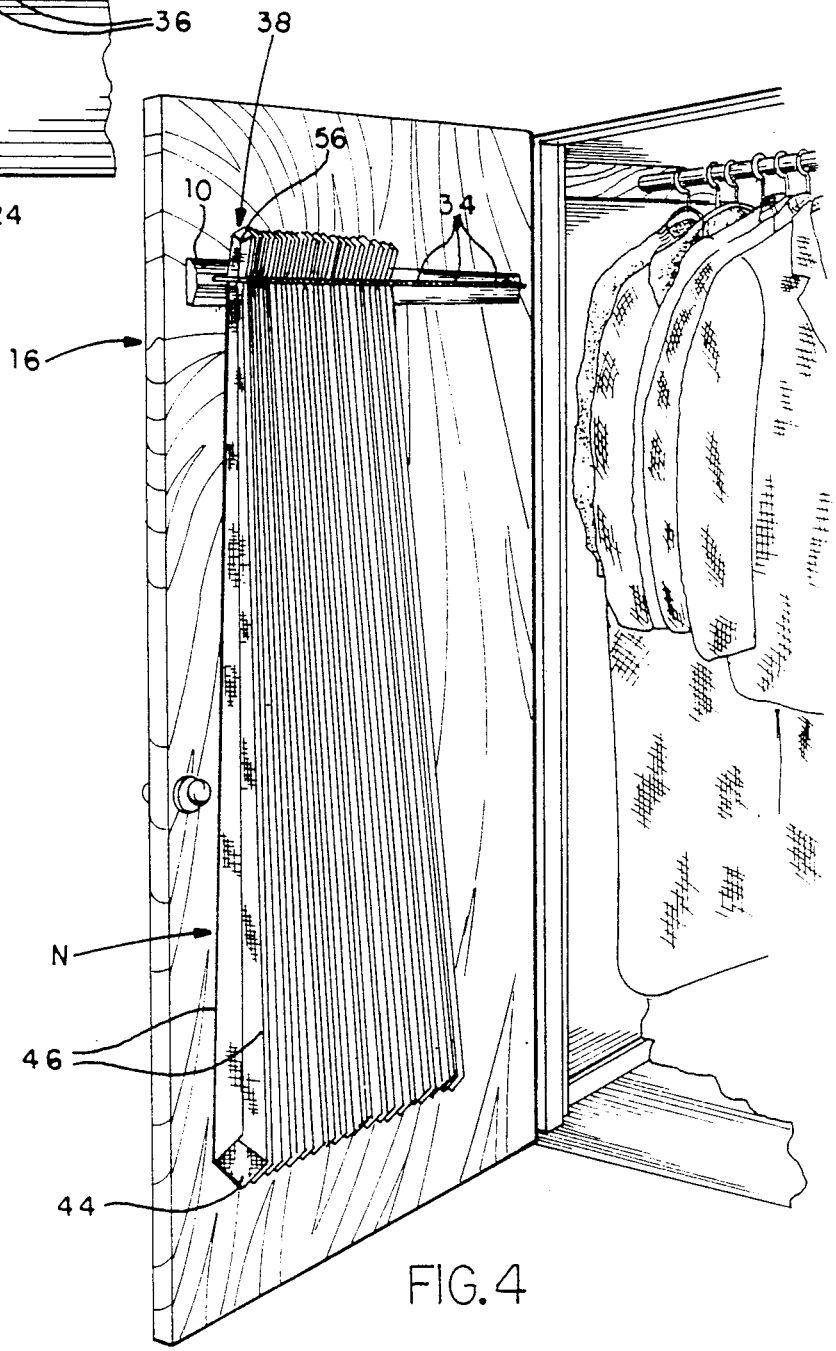
FIG. 4 is a perspective view of the present necktie rack in use, on a closet door.

From the foregoing it will be seen that the 0.070 inch space or throat 36 between adjacent pairs of pins 34 is sufficient to allow for the horizontal insertion and removal of practically all neckties N when this maneuver is accomplished at any point from approximately 3–4 inches from the tail end tip 40, to the front point 44. When a necktie is inserted between a pair of pins in this manner and then released, the entire mass of the necktie, acting under the influence of gravity, serves to urge the tie downwardly until the bulk or thickness as presented by either the tack stitching 60 or the multiple folds adjacent the V-notch area 56, exceeds the available 0.070 inch space 36 and thus retains the necktie N as shown in FIGS. 1, 2 and 4. In this suspended condition, substantially all of the necktie length will be seen to be perfectly straight and accordingly will remain wrinkle-free. Since over 95% of the necktie length is freely suspended, one may readily examine any one of the suspended items. If the rack 10 is being used at near capacity level, with usually well over three feet of the necktie being suspended, it will be appreciated that merely by pulling outwardly upon the front end 44 of any one tie, its color, design etc. may be fully identified. With the relief or clearance area 28 as provided by the reduced thickness of the main body adjacent its bottom wall 32, no portion of the necktie lateral edge 46 will contact the rack beneath the plane of the pins 34, even though the width of the necktie progressively increases beneath the engaged portion thereof.

Although the rack main body 12 may be formed of any length, it is proposed to provide a length of at least say 25 inches. With this arrangement, 147 pins of 0.100 inch diameter may be installed so as to accommodate 146 neckties and such a length is readily adaptable to attachment upon the inside of a door or a closet inside wall. This attachment may be provided by means of any suitable fastening means such as screws 61 or the like inserted through openings 62 or, by means of pressure sensitive adhesive strips 64 carried by the rear surface 18.

The nose 66 of each pin 34 is appropriately rounded to preclude snagging with any necktie fabric. In the use of the rack 10, neckties N always will be inserted by leading with the left-hand edge 50 as this is the edge that overlaps the right-hand edge 51 on the reverse 52 of the necktie. Were one to insert the necktie from the opposite edge, then the likelihood exists that the pin end 66 adjacent the reverse 52 of the tie would slide under the left-hand edge 50 and defeat the intended function of the invention since then, not all of the fabric bulk would be captive between the two adjacent pins 34.

It is to be understood that the present invention is not limited to the sole embodiment described above, but encompasses any and all embodiments within the scope of the following claims.

I claim:

1. A necktie rack accommodating neckties in an unfolded manner comprising;

an elongated base member provided with a front face portion, a plurality of straight pins attached to said base member in a stationary substantially non-yieldable manner and projecting outwardly from said front face portion, said pins disposed parallel one another and forming a substantially horizontal row, adjacent ones of said pins spaced apart from one another and defining a necktie-receiving space therebetween having a dimension of 0.065–0.075 inches, and said spaces closely accepting the insertion of the thickness of a necktie as existing from the front point of a necktie to an area spaced inwardly of the opposite tail end thereof and of a dimension denying the passage of a necktie in that area spaced inwardly of the opposite tail end thereof and which presents an increased bulk, whereby the increased bulk in a necktie in that area spaced inwardly of its tail end serves to retain neckties in an unfolded and fully suspended manner, with said pin spaces preventing downward passage of the necktie increased bulk.

2. A necktie rack according to claim 1 wherein, said pins include an outermost end defining a rounded nose.

3. A necktie rack according to claim 1 wherein, said pins are of stainless steel.

4. A necktie rack according to claim 1 wherein, said pins define a diameter of 0.090–0.110 inches.

5. A necktie rack according to claim 1 wherein, said base member includes upper and lower outer faces, and said front face portion disposed in a substantially vertical plane intermediate said upper and lower outer faces.

6. A necktie rack according to claim 5, wherein said base member includes a rear mounting surface, said lower outer face extending rearwardly from said front face portion toward said rear mounting surface to form a clear area intermediate said lower outer face and said plane of said front face portion.

7. A necktie rack according to claim 6 including, attachment means on said base member permitting fixation of said rear mounting surface upon a substantially vertical surface.

8. A necktie rack comprising;

an elongated base member provided with a front face portion and a rear mounting surface, said base member having upper and lower outer faces, and said front face portion disposed in a substantially vertical plane intermediate said upper and lower outer faces, said lower outer face extending rearwardly from said front face portion toward said rear mounting surface to form a clear area intermediate said lower outer face and said plane of said front face portion, a plurality of pins attached to said base member and projecting outwardly from said front face portion, adjacent pairs of said pins defining a necktie-receiving space therebetween, and said space of a dimension closely accepting the insertion of the thickness of a necktie as existing from the front point of a necktie to an area spaced inwardly of the opposite tail end thereof and of a dimension denying the passage of a necktie in that area spaced inwardly of the opposite tail end thereof, whereby increased bulk in a necktie in that area spaced inwardly of its tail end serves to retain neckties fully suspended, as said pin spaces prevent downward passage of the necktie increased bulk.

9. A necktie rack according to claim 8 wherein, said pins are disposed in a straight line.

10. A necktie rack according to claim 8 wherein, said pins are parallel one another.

11. A necktie rack according to claim 8 wherein, said pins are fixedly mounted upon said base member and said space therebetween defines a dimension of 0.065–0.075 inches.

* * * * *